US005168308A

United States Patent [19]

Hiraike et al.

[11] Patent Number: 5,168,308

[45] Date of Patent: Dec. 1, 1992

[54] CLAMSHELL-TYPE ELECTROPHOTOGRAPHIC IMAGE FORMING APPARATUS

[75] Inventors: Fumiaki Hiraike; Hiroyuki Honda, both of Hachioji, Japan

[73] Assignee: Konica Corporation, Japan

[21] Appl. No.: 557,137

[22] Filed: Jul. 23, 1990

[30] Foreign Application Priority Data

Jul. 29, 1989 [JP] Japan ..... 1-197658
Sep. 18, 1989 [JP] Japan ..... 1-241402
Sep. 20, 1989 [JP] Japan ..... 1-243640

[51] Int. Cl.[5] ..... G03G 5/00
[52] U.S. Cl. ..... 355/211; 355/245
[58] Field of Search ..... 355/200, 211, 245, 210, 355/260

[56] References Cited

U.S. PATENT DOCUMENTS

| | | | |
|---|---|---|---|
| 3,667,840 | 6/1972 | Engel et al. | 355/200 |
| 4,386,841 | 6/1983 | Wakao et al. | 355/200 |
| 4,585,324 | 4/1986 | Koyama et al. | 355/200 |
| 4,702,587 | 10/1987 | Miyoshi | 355/200 |
| 4,760,424 | 7/1988 | Ohba et al. . | |
| 4,862,209 | 8/1989 | Sakamoto et al. | 355/211 |
| 4,873,548 | 10/1989 | Kobayashi et al. | 355/200 |
| 4,882,605 | 11/1989 | Sakamoto | 355/245 X |
| 4,908,661 | 3/1990 | Iwata et al. | 355/211 |
| 4,965,640 | 10/1990 | Watarai et al. | 355/282 X |
| 4,975,744 | 12/1990 | Ebata et al. | 355/211 |

FOREIGN PATENT DOCUMENTS

| | | |
|---|---|---|
| 232064 | 8/1987 | European Pat. Off. . |
| 287122 | 10/1988 | European Pat. Off. . |
| 322219 | 6/1989 | European Pat. Off. . |
| 370455 | 5/1990 | European Pat. Off. . |
| 397465 | 11/1990 | European Pat. Off. . |
| 410730 | 1/1991 | European Pat. Off. . |

OTHER PUBLICATIONS

Patent Abstracts of Japan, vol. 13, No. 319(P-901)(3667); Jul. 19, 1989, JPA-1-88560; Apr. 3, 1989.

*Primary Examiner*—A. T. Grimley
*Assistant Examiner*—Robert Beatty

[57] ABSTRACT

A clamshell-type electrophotographic image forming apparatus in which a drum cartridge by which a photosensitive drum is supported is removably accommodated in a clamshell-type opening/closing unit provided on a base plate so as to be opened and closed. The position of a drum shaft of the photosensitive drum is limited by a positioning device which operates according to the opening or closing of the clamshell-type opening/closing unit, or to the accommodating or removal of the drum cartridge. The drum cartridge is permitted to be attached or detached in a direction at right angles with the axial direction of a support shaft about which a clamshell opening/closing unit turns and the developing cartridge is permitted to be attached or detached in a direction in parallel with the axial direction of the support shaft. A drive gear of the developing unit is opposed to a drive gear of the side of a main body, and the drum cartridge that is attached causes the developing unit to be pushed, such that the drive gear of the developing unit meshes with the drive gear of the side of the main body. In addition, the opening or closing of a toner feeding device operates according to the opening or closing of the clamshell-type opening/closing unit.

4 Claims, 11 Drawing Sheets 51
74
66
67
75
712A
65
73
64
63
60
132
130
131
D
503
500
120
100
90
190
50
110
711
6
80
504
505
713
613
612
603
614
615
625
806
713C
251A
262
259
72
S
62
510A
234C
712
232
231
230
233
234B
234A
713A
618
616
617
619
621
257
258
254
250
251
261
264
200
700
703
703A
709
704
271
272A
703B
701
708
266
267
703C
802
702
705
71
703D
61
800
801
713B
510B
611A
611B
611C
611D
602
Y
600
617
616
618
619
621
257
258
254
250
251
261
264
252
255
200
700
703
703A
709
704
271
272A
703B
701
708
266
267
703C
802
702
705
71
703D
61
800
801
713B
713C
251A
806
625
615
614
603
612
613
713
505
504
80
50
711
6
110
90
510B
611A
611B
611C
611D
602
Y
190
100
120
130
131
132
712A
65
73
64
63
60
D
503
500
510A
234C
712
232
231
230
233
234B
234A
713A
618
616
617
619
621
257
258
254
250
251
261
264

CLAMSHELL-TYPE ELECTROPHOTOGRAPHIC IMAGE FORMING APPARATUS

BACKGROUND OF THE INVENTION

1. Field of the Invention

The present invention relates to a clamshell-type electrophotographic image forming apparatus, and more specifically to a clamshell-type electrophotographic image forming apparatus which reliably holds a photosensitive drum that is detachably attached to a clamshell opening/closing unit.

According to the present invention, the photosensitive drum and the developing device in the clamshell-type electrophotographic image forming apparatus are constructed in the form of cartridges so that they can be detachably attached, facilitating the cleaning and inspection of the photographic image forming apparatus and enabling the cartridges to be renewed safely and reliably after they are used a predetermined number of times.

2. Description of the Prior Art

There has heretofore been provided a clamshell-type electrophotographic image forming apparatus in which a clamshell opening/closing unit is mounted on a base plate so as to be opened and closed, and a drum cartridge by which the photosensitive drum is supported is detachably accommodated in the clamshell opening/-closing unit.

With the drum cartridge being detachably attached, it is possible to closely inspect the interior at the time of checking and cleaning as well as to independently remove the drum cartridge from the apparatus to conduct the checking and cleaning, enabling an operator to carry out the operation very efficiently.

There have further been provided electrophotographic image forming apparatus in which the photosensitive drum and the developing device are contained in a single detachable unit, or a unit containing the photosensitive drum and a unit containing the developing device are detachably attached, so that the interior of the electrophotographic image forming apparatus can be easily and reliably checked and cleaned and that the parts can be replaced. Heretofore known solutions however were not satisfactory.

There is a limit in the number of times of using the photosensitive member for forming images; i.e., the photosensitive member must usually be renewed after it is used, for example, after 10,000 times, 30,000 times or 50,000 times. There also exists a limit in the number of times of using the developing means for forming images; i.e., the developing means must be renewed after being used for a predetermined number of times.

Further, the developing device has been constructed in a unit which permits the developing means only to be detachably attached but does not permit the toner feeding tank or the toner feeding device to be removed. Or the developing device has been constructed in such a system that the toner contained in the developing means is used without particularly providing the toner feeding device, so that the developing means is renewed when it is depleted, the used developing means being discarded.

With the photosensitive drum and the developing device being detachably attached as described above, it is possible to closely inspect the interior of the image forming apparatus at the time of checking and cleaning. Moreover, the individual units can be independently taken away to the external side facilitating checking and cleaning and enabling the operation to be carried out very efficiently. Further, there are limits in the number of times for using the units which, therefore, must be renewed after they are used a predetermined number of times.

The drum cartridge by which the photosensitive drum is supported is inserted in the clamshell opening/-closing unit from a side in which it is opened, and is pulled out in a direction opposite to the direction in which it was inserted. The drum cartridge inserted in the clamshell opening/closing unit is not limited for its position in the direction in which it is taken out. Therefore, when the clamshell opening/closing unit is closed, the position of the photosensitive drum is deviated to adversely affect the formation of image.

The photosensitive member and the developing means have durability for maintaining images of good quality, durability being determined roughly by the number of times for forming the images. These members must be renewed before their durability ends, and the interior of the image forming apparatus must be checked and cleaned before the durability ends such that the apparatus maintains proper functions at all times. These operations should desirably be carried out correctly without requiring skill through a simple procedure. For this purpose, it has heretofore been attempted to contain the photosensitive member, developing means and accessories thereof in a cartridge to facilitate the attachment, detachment, checking and cleaning.

However, the developing roller (developing sleeve) of the developing device is nearly in contact with the surface of the photosensitive drum, and both ends of the sleeve are in many cases in contact with the surface of the photosensitive drum. Under such a condition, if the cartridge for the photosensitive drum and the cartridge for the developing device are separately attached or detached in the same direction, the surface of the drum and both ends of the developing sleeve come into rubbing contact with each other to damage the surface of the drum. Should that happen, the operation of checking and cleaning loses becomes meaningless, and the finished image is deteriorated causing a serious problem. In order to prevent disturbance caused by the rubbing between them, one method consists of accommodating the photosensitive drum and the developing means in a single cartridge. This unitary structure, however, causes a problem in that checking cannot be effected closely, and the cleaning and checking involve difficulty and become incomplete.

Furthermore, in order to check and clean the image forming apparatus and to maintain high image quality at all times, it is better that important units such as the photosensitive drum and the developing device are independently attachable and detachable and that the units have further been divided.

In practice, however, when a drive gear of the developing unit is in mesh with a drive gear of the main body, it becomes difficult to attach or detach the developing unit. Moreover, the photosensitive drum is scarred when the developing unit is attached or detached under the condition where the drum cartridge supporting the photosensitive drum has been mounted.

SUMMARY OF THE INVENTION

An object of the present invention is to provide a clamshell-type electrophotographic image forming apparatus which is free from the above-mentioned problems.

In order to attain the above-mentioned object, the present invention deals with a clamshell-type electrophotographic image forming apparatus wherein a clamshell opening/closing unit is provided on a base plate so as to be opened and closed, and a drum cartridge by which a photosensitive drum is supported is removably accommodated in the clamshell-type opening/closing unit, and wherein the position of a drum shaft of the photosensitive drum of the drum cartridge accommodated in the clamshell opening/closing unit is limited by positioning means which operates according to the opening or closing of said clamshell opening/closing unit.

The present invention further deals with a clamshell-type electrophotographic image forming apparatus wherein a clamshell-type opening/closing unit is provided on a base plate so as to be opened and closed, and a drum cartridge by which a photosensitive drum is supported is removably accommodated in the clamshell opening/closing unit, and wherein the position of a drum shaft of the photosensitive drum of the drum cartridge accommodated in the clamshell opening/closing unit is limited by positioning means which operates according to the accommodation or removal of said drum cartridge.

According to the apparatus of the present invention, the drum cartridge by which the photosensitive drum is supported is inserted in the clamshell opening/closing unit which is then closed toward the base plate. Then, the positioning means operates interlocking thereto and the drum shaft of the photosensitive drum is held in position. When the clamshell opening/closing unit is opened from the base plate for the purpose of checking and cleaning, the positioning means operates interlocking thereto and the drum shaft of the photosensitive drum is released from its position.

According to the apparatus of the present invention, furthermore, the drum cartridge supporting the photosensitive drum is inserted in, and is held by, the clamshell opening/closing unit. Then, the positioning means operates interlocking thereto and the drum shaft of the photosensitive drum is held in position. When the drum cartridge is removed from the clamshell opening/closing unit for the purpose of checking and cleaning, the positioning means operates interlocking thereto and the drum shaft of the photosensitive drum is released from its position.

The aforementioned object is achieved further by a clamshell-type electrophotographic image forming apparatus which comprises a drum cartridge that contains a photosensitive drum and a developing cartridge that contains developing means, wherein the drum cartridge is permitted to be attached or detached in a direction at right angles with the axial direction of a support shaft about which the clamshell opening/closing unit turns and said developing cartridge is permitted to be attached or detached in a direction in parallel with the axial direction of said support shaft.

Another object of the present invention is to provide a clamshell-type electrophotographic image forming apparatus which permits a developing unit to be smoothly attached and detached without causing a drum unit and the like to be scarred.

In order to attain the above-mentioned object, the present invention deals with a clamshell-type electrophotographic image forming apparatus which comprises a drum cartridge by which a photosensitive drum is supported, and a developing unit that has developing means, the drum cartridge and the developing unit being allowed to be attached and detached, wherein a drive gear of said developing unit is opposed to a drive gear of the side of a main body, and said drum cartridge that is attached causes said developing unit to be pushed, such that the drive gear of said developing unit meshes with the drive gear of the side of the main body.

In the apparatus of the present invention, the drum cartridge that is attached causes the developing unit to be pushed, such that the drive gear of the developing unit meshes with the drive gear of the side of the main body. Under the condition where the drum cartridge is attached, it is not allowed to attach or detach the developing unit.

Under the condition where the drum cartridge is not attached, the drive gear of the developing unit is not in mesh with the drive gear of the side of the main body and the developing unit can be easily removed. When the developing unit is being attached or detached, there is no drum cartridge that is attached. Therefore, the photosensitive drum supported by the drum cartridge is not scarred.

Other objects and features of the present invention will become obvious from the following description taken in conjunction with the accompanying drawings.

BRIEF DESCRIPTION OF THE DRAWINGS

FIGS. 1 to 3 illustrate an electrophotographic image forming apparatus according to an embodiment of the present invention, wherein:

FIG. 1 is a perspective view;

FIG. 2 is a side view of when a clamshell opening/-closing unit is closed; and FIG. 3 is a side view of when the clamshell opening/-closing unit is opened;

FIGS. 4 to 6 illustrate another embodiment of the invention, wherein:

FIG. 4 is a view illustrating positioning means;

FIG. 5 is a view of when the clamshell opening/closing unit is closed; and

FIG. 6 is a view of when the clamshell opening/closing unit is opened;

FIGS. 7 and 8 illustrate another embodiment, wherein:

FIG. 7 is a side view of a mechanism for mounting a drum cartridge on the clamshell opening/closing unit; and FIG. 8 is a plan view thereof;

FIGS. 9 to 11 illustrate a further embodiment, wherein:

FIG. 9 is a view of before the drum cartridge is attached;

FIG. 10 is a view of when the drum cartridge is attached; and

FIG. 11 is a view of when the drum cartridge is to be detached;

FIGS. 12 to 15 illustrate a still further embodiment, wherein:

FIGS. 12 and 13 are left and right sectional views thereof;

FIG. 14 is a plan view thereof; and

FIG. 15 is a perspective view of when the clamshell is opened.

EMBODIMENTS

Embodiments of the invention will now be described in detail in conjunction with the accompanying drawings.

Figure 1:
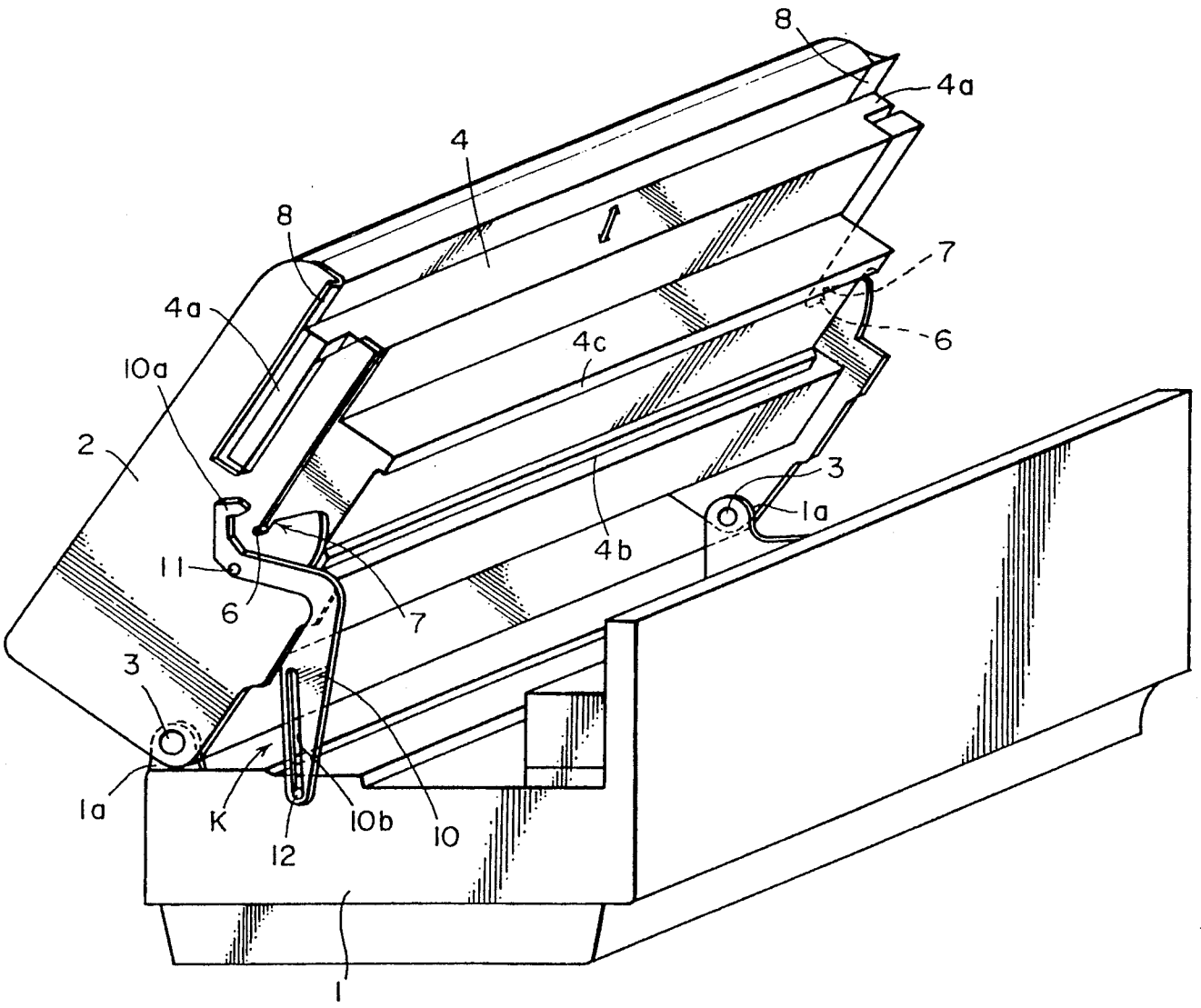
Figure 2:
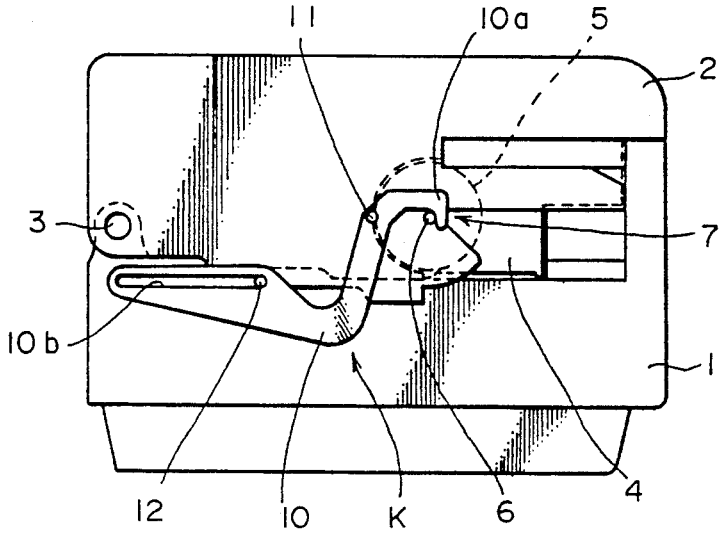
Figure 3:
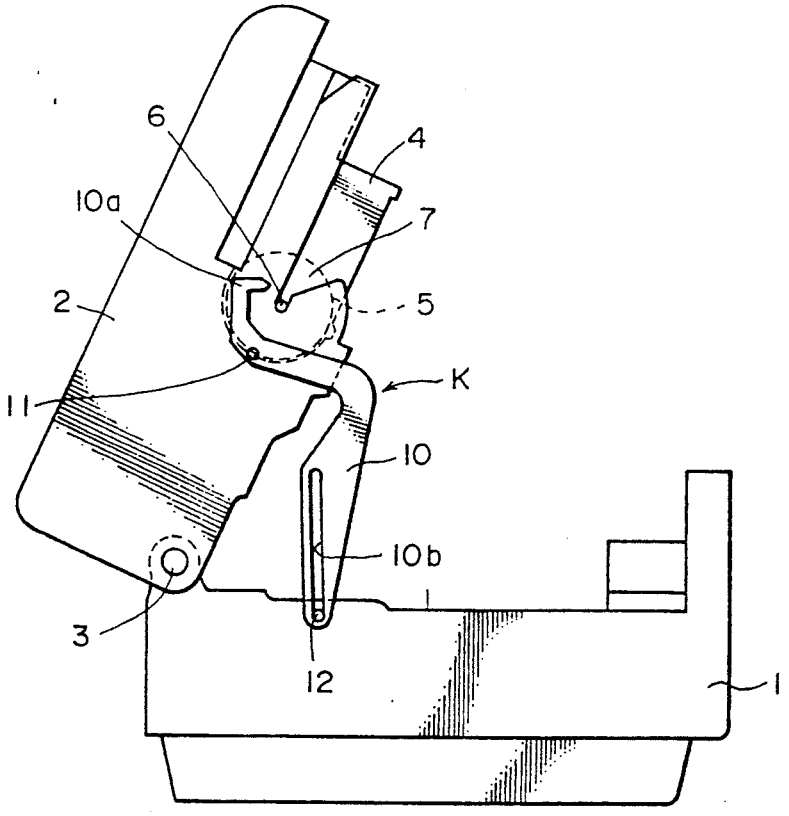

FIGS. 1 to 3 illustrate an embodiment of an electrophotographic image forming apparatus of the present invention, wherein FIG. 1 is a perspective view, FIG. 2 is a side view of the condition where a clamshell opening/closing unit is closed, and FIG. 3 is a side view of the condition where the clamshell opening/closing unit is opened.

In FIGS. 1 to 3, reference numeral 1 denotes a base plate, and 2 denotes a clamshell opening/closing unit. The base plate 1 is provided at its rear part with bearings la in which are rotatably provided shafts 3 of the clamshell opening/closing unit 2. The clamshell opening/closing unit 2 is opened or closed at its front part with respect to the base plate 1 on the front side of the apparatus.

Though not shown, the base plate 1 is provided with a recording paper carrier mechanism and a transfer unit, and a toner image is transferred onto a recording paper at a contact portion to the peripheral surface of a photosensitive drum 5 supported by a drum cartridge 4. The base plate 1 is further provided with a fixing device, and the recording paper to which the toner image is transferred at the transfer unit is separated from the peripheral surface of the photosensitive drum 5 and is supplied to a fixing device.

Though not shown, the clamshell opening/closing unit 2 is provided with a laser write-system unit which is an exposure optical system and a developing unit. Further, the drum cartridge 4 by which the photosensitive drum 5 is supported, is detachably attached to the clamshell opening/closing unit 2. The drum cartridge 4 is provided with a cleaner, a charging device, a precharging electrode, a toner recovering unit and the like that are not shown.

When the clamshell opening/closing unit 2 is opened as shown in the perspective view of FIG. 1, guides 4*a* on both sides of the drum cartridge 4 can be slidingly guided along guide introduction unit 8 so as to be easily attached or detached. A drum shaft 6 of the photosensitive drum 5 is rotatably supported by the drum cartridge 4, and is fitted to shaft support portions 7 on both sides of the clamshell opening/closing unit 2.

The drum cartridge 4 is provided with legs 4*b* and 4*c* such that when the drum cartridge 4 is removed from the clamshell opening/closing unit 2 and placed on a plate, the checking and cleaning thereof can be easily effected. When the clamshell opening/closing unit 2 is being opened as described above, the drum cartridge 4 can be attached or detached to facilitate the maintenance and checking, or can be replaced by a new one.

The clamshell-type electrophotographic image forming apparatus is provided with positioning means K, and the drum shaft 6 of the photosensitive drum 5 with the drum cartridge 4 inserted in the clamshell opening/closing unit 2 is operated interlocking to the opening or closing of the clamshell opening/closing unit 2, in order to determine the position of the photosensitive drum 5.

That is, a position limiting lever 10 is rotatably supported by a pin 11 on the side of the clamshell opening/closing unit 2. The position limiting lever 10 has an engaging pawl 10*a* and a guide groove 10*b*, the engaging pawl 10*a* engaging with the drum shaft 6 of the photosensitive drum 5 to urge it to the shaft support portions 7, thereby to limit the position of the photosensitive drum 5. A guide pin 12 secured to the base plate 1 is fitted to the guide groove 10*b* of the position limiting lever 10 to permit the movement of the position limiting lever 10, so that the clamshell opening/closing unit 2 can be opened and closed and that the position limiting lever 10 is turned to limit the position of the drum shaft 6 of the photosensitive drum 5.

When the clamshell opening/closing unit 2 is closed as shown in FIG. 2, therefore, the pin 12 of the base plate 1 is positioned at the upper end of the guide groove 10*b* of the position limiting lever 10, and the engaging pawl 10*a* of the position limiting lever 10 engages with the drum shaft 6 of the photosensitive drum 5. Under this condition of engagement, the engaging pawl 10*a* of the position limiting lever 10 is positioned to fit the photosensitive drum to the clamshell opening/closing unit 2; i.e., the photosensitive drum 5 is placed in position so as to be operated properly.

When the clamshell opening/closing unit 2 is opened as shown in FIG. 3 for the purpose of checking and cleaning, the guide groove 10*b* of the position limiting lever 10 slidingly guided by the pin 12 of the base plate 1, and whereby the position limiting lever 10 turns in the counterclockwise direction. Therefore, the pin 12 is positioned at the lower end of the guide groove 10*b* of the position limiting lever 10, the engaging pawl 10*a* releases the engagement of the drum shaft 6 of the photosensitive drum 5, and the drum cartridge 4 is permitted to be pulled out from the front side.

Figure 4:
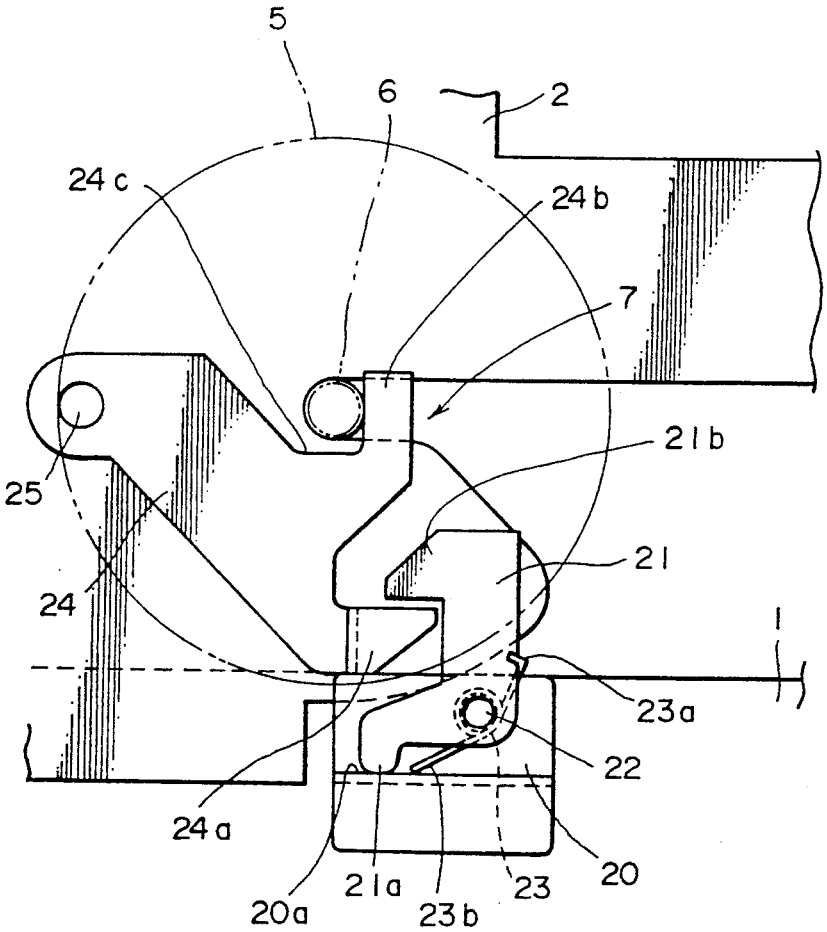
Figure 5:
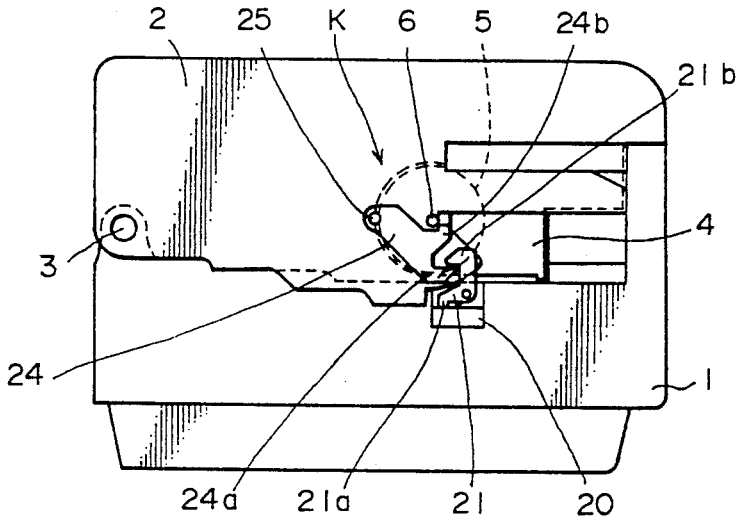
Figure 6:
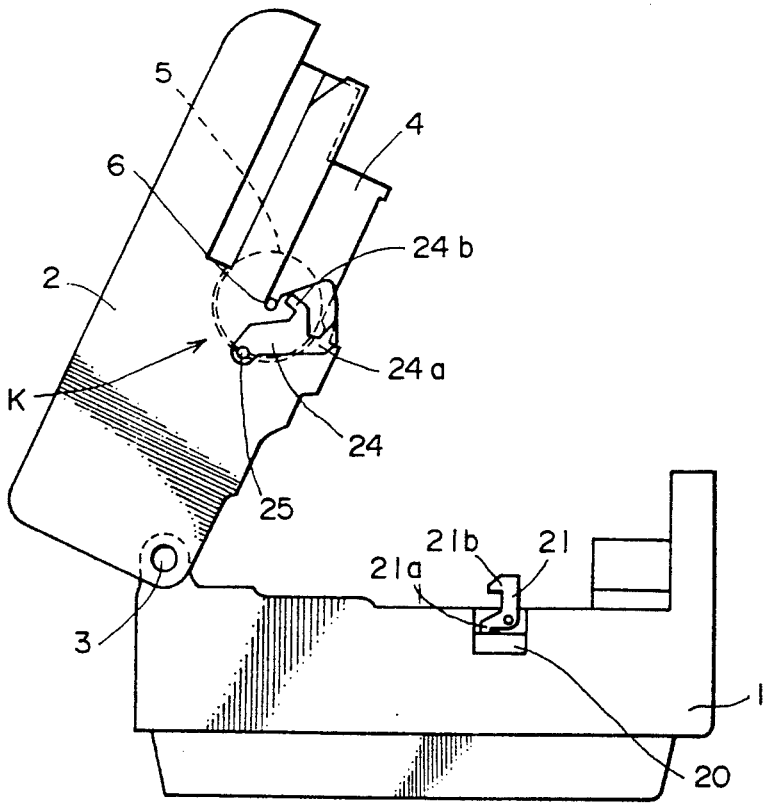

FIGS. 4 to 6 illustrate another embodiment, wherein FIG. 4 is a view showing positioning means, FIG. 5 is a view showing the condition where the clamshell opening/closing unit is closed, and FIG. 6 is a view showing the condition where the clamshell opening/closing unit is opened.

In this embodiment, the members same as those of the embodiment of FIGS. 1 to 3 are denoted by the same reference numerals but are not explained here again.

A bracket 20 is fastened to the base plate 1, a fixing lever 21 is rotatably supported by the bracket 20 using a pin 22, one end 23*a* of a spring 23 fitted to the pin 22 engages with the fixing lever 21, the other end 23*b* thereof is forcibly pressed to a stepped part 20*a* of the bracket 20, a stopper part 21*a* of the fixing lever 21 is forcibly contacted to a stepped part 20*a*, and the fixing lever 21 is so urged as to be erected at all times.

The clamshell opening/closing unit 2 has a position limiting lever 24 that is rotatably supported by a pin 25 at a position opposed to the fixing lever 21, the position limiting lever 24 having an engaging pawl 24*a* and a stopper part 24*b*.

When the clamshell opening/closing unit 2 is moved to close, therefore, the engaging pawl 24*a* of the position limiting lever 24 comes in contact with an engaging pawl 21*b* of the fixing lever 21. Therefore, the drum shaft 6 of the photosensitive drum 5 comes into contact with a recessed part 24*c* of the position limiting lever 24 which is then pushed. When the clamshell opening/closing unit 2 is closed, the engaging pawl 24*a* of the position limiting lever 24 pushes the engaging pawl 21*b* of the fixing lever 21 which is then rotated in the clockwise direction overcoming the spring 23. When the engaging pawl 24*a* of the position limiting lever 24 disengages from the engaging pawl 21*b* of the fixing lever 21, the engaging pawl 24*a* of the position limiting lever 24 comes in contact with the bracket 20 and is held thereby, and the fixing lever 21 is returned by the spring to the initial position, so that the engaging pawl 21b engages with the engaging pawl 24a of the position limiting lever 24. Under this condition, the drum shaft 6 of the photosensitive drum 5 is positioned in the recessed part 24c of the position limiting lever 24, and the stopper part 24b is positioned to retain the photosensitive drum 5 in the shaft support portions 7 of the clamshell opening/closing unit 2, so that the photosensitive drum 5 properly operates at a predetermined position.

When the clamshell opening/closing unit 2 is moved to open for the purpose of checking and cleaning, the drum shaft 6 of the photosensitive drum 5 is disengaged from the recessed part 24c of the position limiting lever 24 since the engaging pawl 24a of the position limiting lever 24 has still engaged with the engaging pawl 21b of the fixing lever 21. When the clamshell opening/closing unit 2 is opened, furthermore, the engaging pawl 24a of the position limiting lever 24 is disengaged from the engaging pawl 21b of the fixing lever 21, and the drum cartridge 4 is permitted to be pulled out from the front side of the apparatus.

Figure 7:
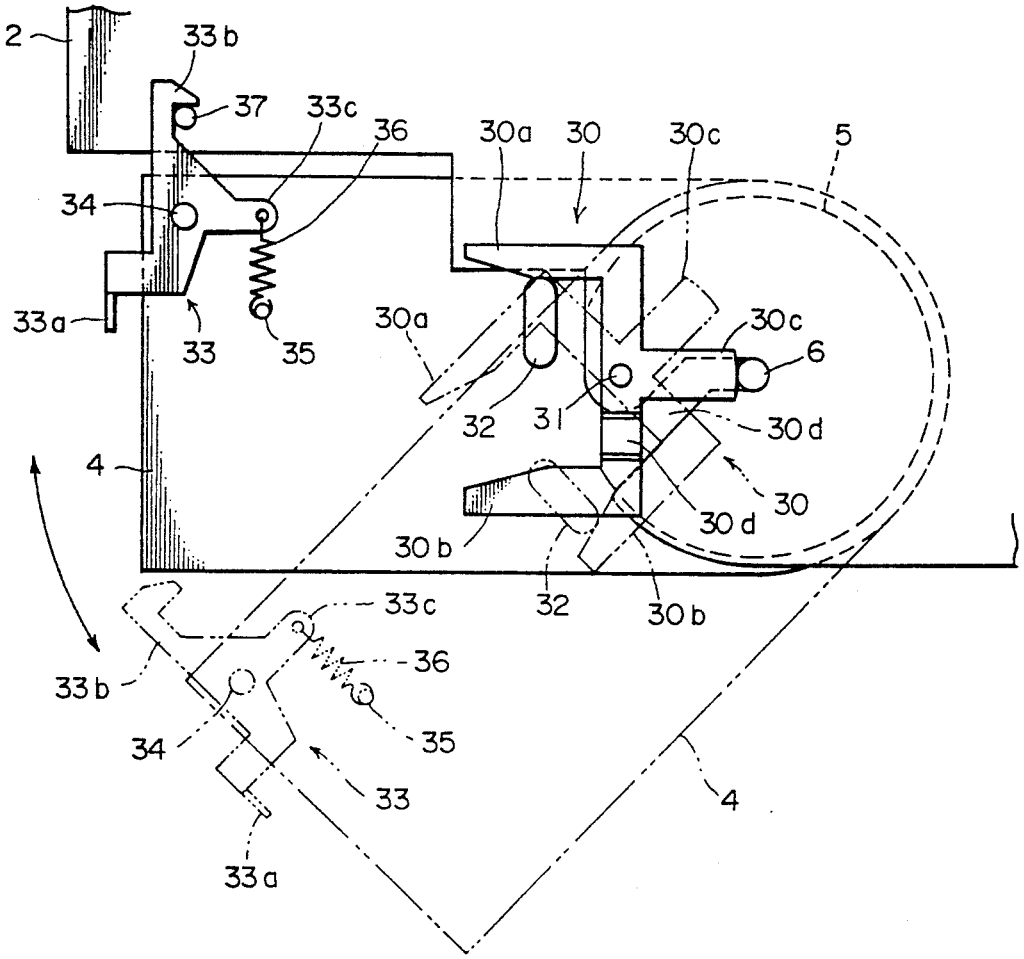
Figure 8:
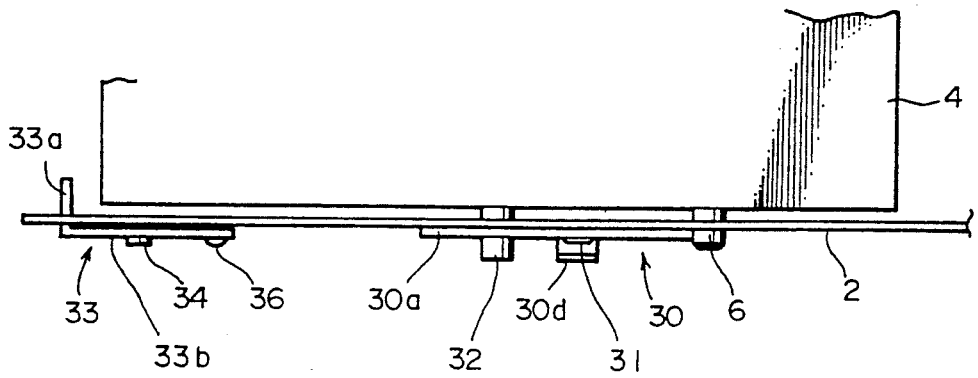

FIGS. 7 and 8 illustrate a further embodiment, wherein FIG. 7 is a side view of a mechanism for mounting the drum cartridge on the clamshell opening/closing unit and FIG. 8 is a plan view thereof.

Even in this embodiment, the members denoted by the same reference numerals as those of the embodiment of FIGS. 1 to 3 are constructed in the same manner and are not explained again.

A position limiting lever 30 is rotatably supported by a pin 31 near the shaft support portions 7 of the clamshell opening/closing unit 2, the position limiting lever 30 having an engaging pawl 30a, a disengaging pawl 30b and a stopper 30c, the disengaging pawl 30b further having an escape portion 30d for the drum shaft 6 of the photosensitive drum 5 to permit the mounting of the photosensitive drum 5. Further, the disengaging pawl 30b is downwardly protruded beyond the shaft support portions 7. The downwardly protruded end of the disengaging pawl 30b guides the drum shaft 6, so that the drum cartridge 4 can be smoothly mounted.

An operation protrusion 32 is formed on the side wall of the drum cartridge 4, so as to be positioned between the engaging pawl 30a and the disengaging pawl 30b of the position limiting lever 30 under the condition where the drum shaft 6 of the photosensitive drum 5 is engaged with the shaft support portions 7 of the clamshell opening/closing unit 2. When the drum cartridge 4 is turned in a direction to approach the clamshell opening/closing unit 2 under the condition where the drum shaft 6 of the photosensitive drum 5 engages with the shaft support portions 7 of the clamshell opening/closing unit 2, the operation protrusion 32 comes into contact with the engaging pawl 30a of the position limiting lever 30. When the drum cartridge 4 is mounted on the clamshell opening/closing unit 2, the stopper 30c moves to a position opposed to the drum shaft 6 to limit the position. The drum cartridge 4 is removed by turning it in a direction to separate away from the clamshell opening/closing unit 2 with the drum shaft 6 as a fulcrum. Then, the operation protrusion 32 turns coming in contact with the disengaging pawl 30b of the position limiting lever 30, whereby the stopper 30c moves away from the position opposed to the drum shaft 6 permitting the drum cartridge 4 to be removed.

The drum cartridge 4 is provided with a lock lever 33 which is rotatable with a pin 34 as a fulcrum, the lock lever 33 having an operation part 33a, a lock pawl 33b and a holding part 33c, and being urged by a spring 36 that is provided between the holding part 33c and a pin 35 of the drum cartridge 4. The clamshell opening/closing unit 2 is provided with an engaging pin 37 at a position opposed to the lock pawl 33b of the lock lever 33.

In mounting the drum cartridge 4 on the clamshell opening/closing unit 2, a tilted portion of lock pawl 33b of the lock lever 33 comes into engagement with the engaging pin 37, the lock lever 33 turns in the counterclockwise direction against the spring 36, and the engaging pin 37 disengages from the tilted portion. Then, the drum cartridge 4 is mounted on the clamshell opening/closing unit 2, the lock lever 33 turns in the clockwise direction by the spring 36 to return to the initial position, and whereby the lock pawl 33b of the lock lever 33 engages with the engaging pin 37 and is locked.

To remove the drum cartridge 4, the operation part 33a of the lock lever 33 is depressed under the condition where the drum cartridge 4 is mounted on the clamshell opening/closing unit 2, whereby the lock lever 33 turns in the counterclockwise direction against the spring 36, the lock pawl 33b disengages from the engaging pin 37, and the drum cartridge 4 is permitted to turn in a direction to separate away from the clamshell opening/closing unit 2 with the drum shaft 6 as a fulcrum.

According to this embodiments, the drum shaft 6 of the photosensitive drum 5 is positioned under the condition where the drum cartridge 4 by which the photosensitive drum 5 is supported, is inserted in the clamshell opening/closing unit 2 irrespective of the opening or closing of the clamshell opening/closing unit 2. Therefore, the photosensitive drum 5 can be stably held even if the clamshell opening/closing unit 2 or the drum cartridge 4 is moved at the time of checking and cleaning, or even if the clamshell opening/closing unit 2 is opened or closed.

Figure 9:
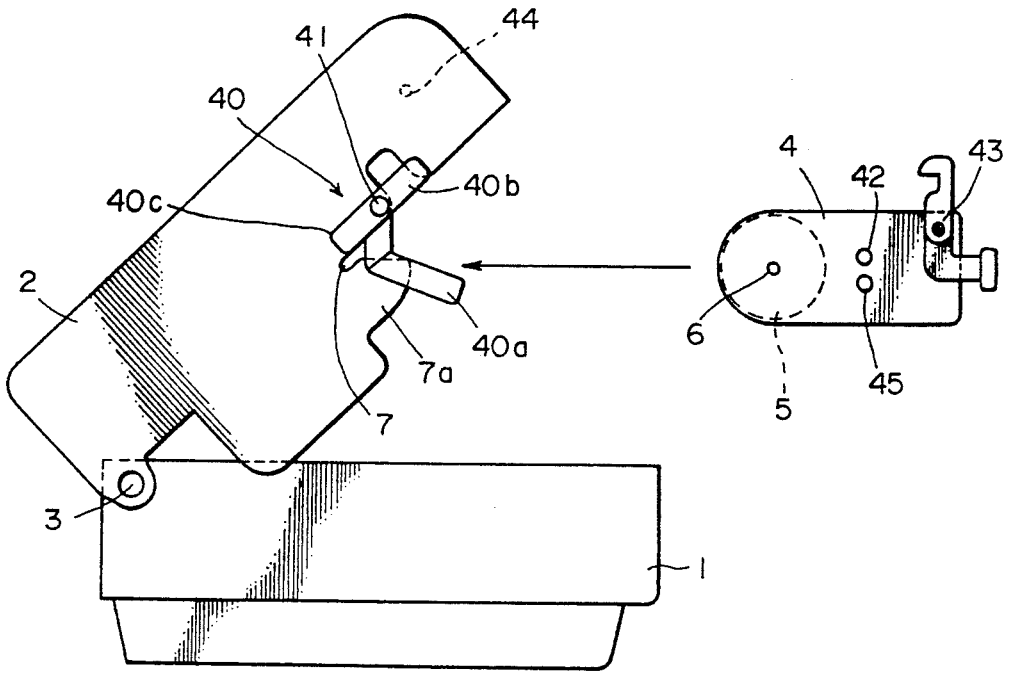
Figure 10:
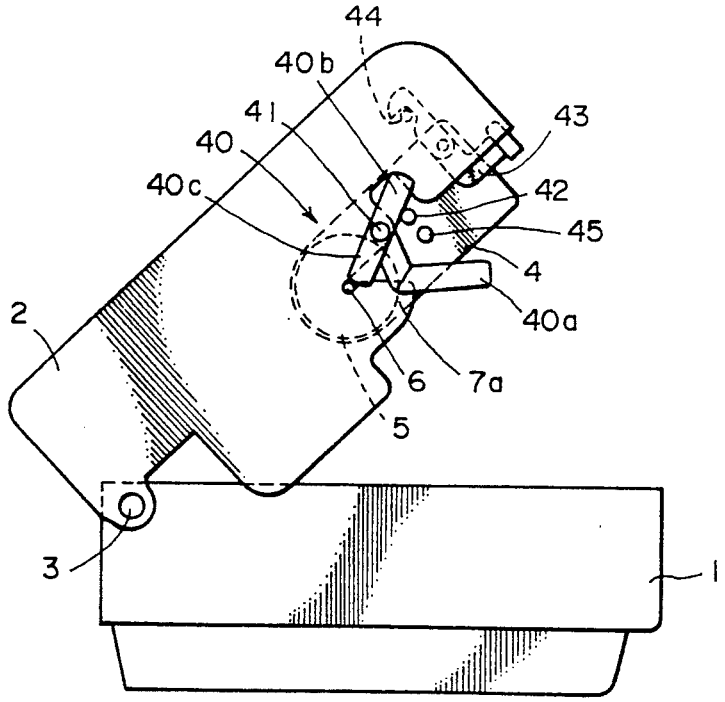
Figure 11:
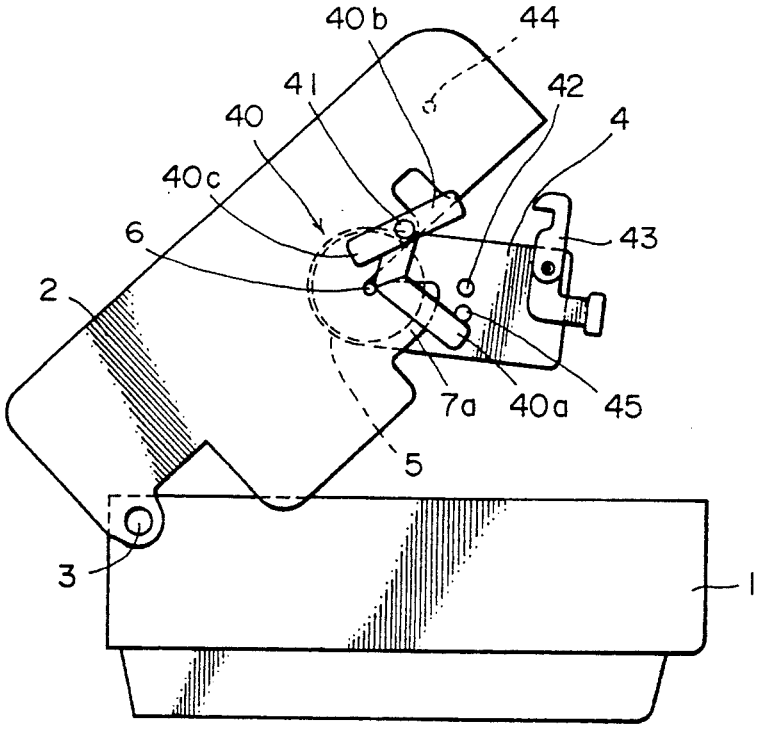

FIGS. 9 to 11 illustrate a yet further embodiment, wherein FIG. 9 is a view showing the condition of before the drum cartridge is being mounted, FIG. 10 is a view showing the condition of when the drum cartridge is mounted, and FIG. 11 is a view showing the condition of when the drum cartridge is being removed.

This embodiment is the same as the embodiment shown in FIGS. 7 and 8, and wherein a position limiting lever 40 is rotatably provided on the clamshell opening/closing unit 2 via a pin 41, the position limiting lever 40 having an elongated guide pawl 40a of an L-shape, such that the drum shaft 6 of the photosensitive drum 5 supported by the drum cartridge 4 is guided and is smoothly accommodated in the shaft support portions 7 of the clamshell opening/closing unit 2. The guide pawl 40a of the position limiting lever 40 enables the drum cartridge 4 to be easily mounted, and makes it possible to decrease the amount of protrusion of a guide portion 7a of shaft support portions 7 of the clamshell opening/closing unit 2.

When the drum cartridge 4 is mounted on the clamshell opening/closing unit 2, a protrusion 42 depresses the engaging pawl 40b of the position limiting lever 40, whereby the stopper 40c comes in contact with the drum shaft 6 of the photosensitive drum 5 to limit the position. Under this condition, a lock lever 43 is operated to engage with an engaging pin 44 provided on the clamshell opening/closing unit 2, so that the drum cartridge 4 is held by the clamshell opening/closing unit 2.

To remove the drum cartridge 4, the lock lever 43 is disengaged from the engaging pin 44 in FIG. 10 and is turned downwards. Then, a protrusion 45 turns coming in contact with the guide pawl 40*a* of the position limiting lever 40, and the stopper 40*c* of the position limiting lever 40 is released from its position, enabling the drum cartridge 4 to be removed.

Figure 12:
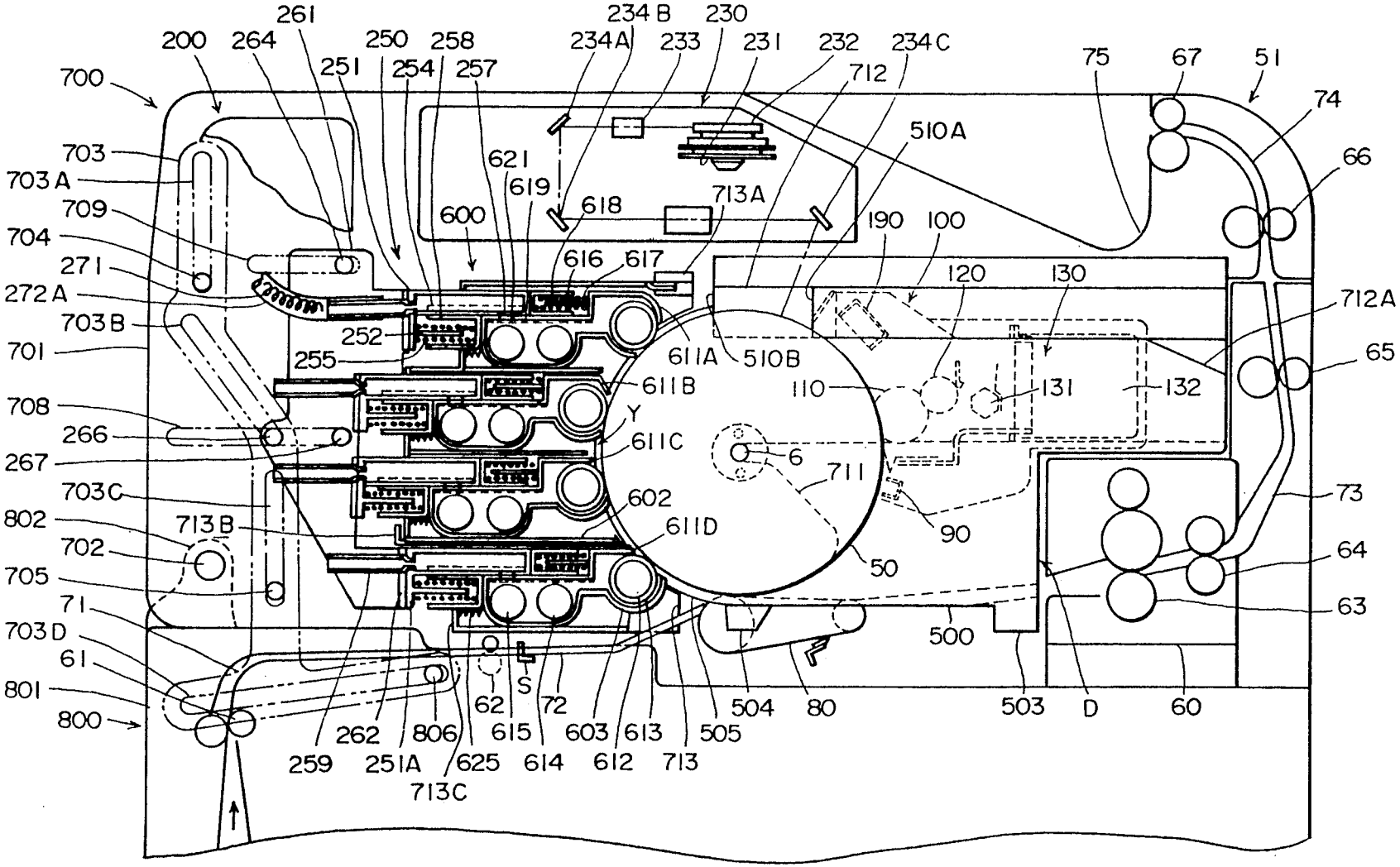
Figure 13:
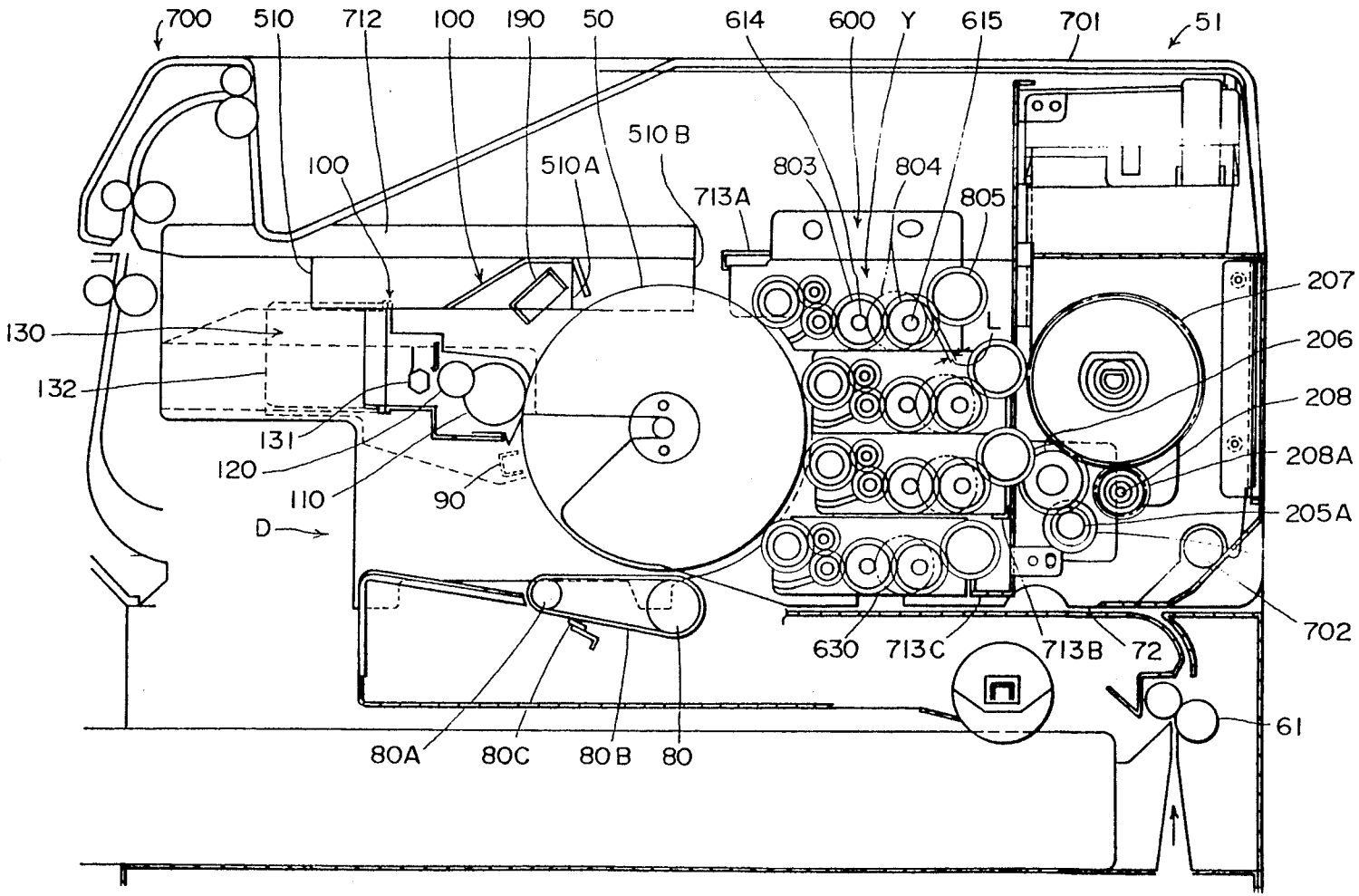
Figure 14:
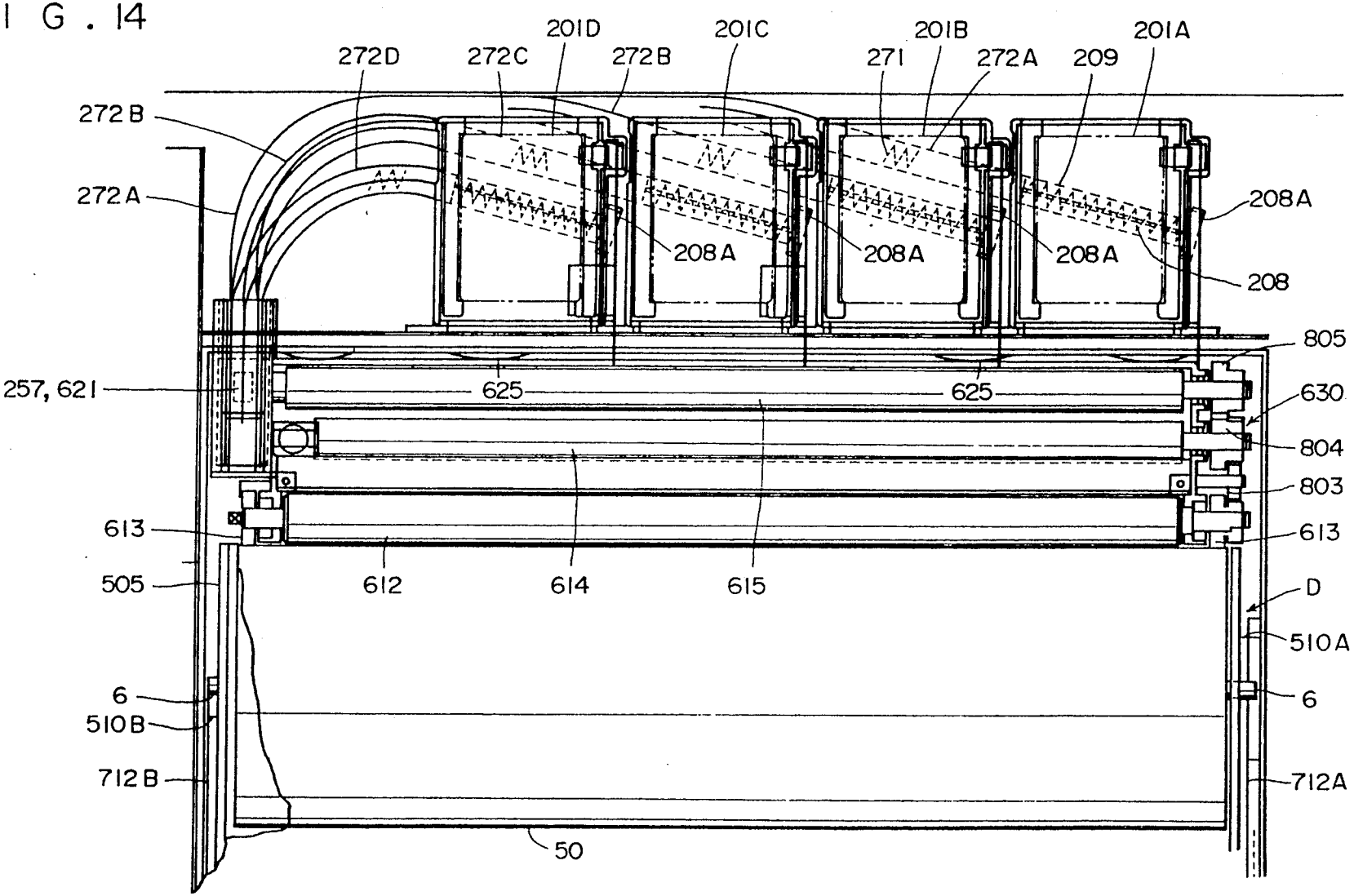

FIGS. 12 to 15 illustrate yet further embodiment of the present invention, wherein FIG. 12 is a sectional view along the line X—X' of FIG. 14 that is a plan view of this embodiment.

In FIGS. 12 to 15, reference numeral 50 denotes an image retainer of the form of a drum, i.e., denotes a photosensitive drum which is rotated in the clockwise direction in FIG. 13 and in the counterclockwise direction in FIG. 12. Reference numeral 190 denotes a charging electrode for imparting electric charge to the photosensitive member on the peripheral surface of the photosensitive drum 50, and 230 denotes a laser write-system unit which is an exposure optical system.

When a laser write signal is input to the laser write-system unit 230, a laser beam generated from a semiconductor laser (not shown) is scanned by a polygonal mirror 232 which is driven by a drive motor 231, and reflected through an f$\theta$ lens 233 and three mirrors 234A, 234B and 234C, and is then projected onto the peripheral surface of the photosensitive drum 50 to which the electric charge has been imparted by the charging electrode 190.

When the scanning is started, the laser beam is detected by an index sensor, modulation of the laser beam is started by a first chrominance signal, and the modulated laser beam scans the peripheral surface of the photosensitive drum 50. Therefore, a latent image for the first color is formed on the peripheral surface of the photosensitive drum 50 owing to the main scanning by the laser beam and the turn of the photosensitive drum 50 in the sub-scanning direction. The latent image is developed by developing means which contains, for example, a yellow developer the first color, and a yellow toner image is formed on the peripheral surface of the photosensitive drum 50. The obtained toner image is held on the peripheral surface of the photosensitive drum 50, passes under the cleaning means located away from the peripheral surface of the photosensitive frum 50, and enters into the next copy cycle.

That is, the photosensitive drum 50 is electrically charged again by the charging electrode 190, a second chrominance signal produced from a signal processing unit is input to the write-system unit 230, and the second color signal is written onto the peripheral surface of the photosensitive drum 50 to form a latent image just like the aforementioned case of the first chrominance signal. The latent image is developed by developing means which contains, for example, a magenta developer as a second color.

The magenta toner image is superposed on the above-mentioned yellow toner image that has been formed already.

The thus obtained toner image is held on the peripheral surface of the photosensitive drum 50, passes under the cleaning means that is located being separated away from the peripheral surface of the photosensitive drum 50, and enters into the next copy cycle.

Similarly, a third chrominance signal is written on the photosensitive drum 50 to form a latent image which is then developed by developing means that contains, for example, a cyan developer as a third color. The cyan toner image is superposed on the aforementioned yellow and magenta toner images.

As described above, a color toner image is formed by toners of three colors on the photosensitive drum 50. Similarly, a black toner image can further be superposed thereon to obtain a color image of high quality.

Reference numerals 611A, 611B, 611C and 611D denote developing means containing yellow, magenta, cyan and black developers for performing the developing.

As represented by developing means 611A, each of the developing means comprises a developing roller (developing sleeve) 612 having magnetic poles secured on the inside opposed to the peripheral surface of the photosensitive drum 50 maintaining a predetermined gap, and a pair of stirring rollers 614 and 615 that produce carrying force in the directions opposite to each other. Due to the mixing action by the stirring rollers 614 and 615, the toner and carrier components in the developer are homogeneously mixed to together and are supplied to the peripheral surface of the developing roller (developing sleeve) 612 that is rotating.

A DC or AC bias is further applied to the developing roller (developing sleeve ) of the developing means carrying the developer, and a non-contacting reversal developing is effected by the two-component developer.

The electric charging of the photosensitive drum 50 by the charging electrode 190 provided at the periphery thereof, the exposure by the laser write-system unit 230, and the developing by the developing means 611A, 611B, 611C and 611D, are carried out four times for each of the colors, and a color toner image is formed on the peripheral surface of the photosensitive drum 50 by superposition.

Reference numerals 61 and 62 denote a first paper-feed roller and a second paper-feed roller that are rotating at all times, and reference numerals 71 and 72 denote paper-feed guides having an arcuate shape and a straight shape, respectively.

A recording paper carried sheet by sheet from a paper feed cassette is sent by the first paper-feed roller 61 along the paper-feed guide 71 and is U-turned, i.e., inverted upside down, and is once stopped upon contact with the rising part of a paper-feed shutter S that interrupts the carrier path of the paper-feed guide 72. In this case, the second paper-feed roller 62 continues to rotate slipping on the recording paper that is at rest.

As the paper-feed shutter S downwardly retreats maintaining a timing with respect to the turn of the photosensitive drum 50 that has the toner image, the recording paper is fed to the transfer unit in synchronism with the peripheral speed of the photosensitive drum 50 owing to the frictional force of the second paper-feed roller 62.

Reference numeral 80 denotes a rotary transfer roller which is electrically charged when a voltage is applied thereto, and which constitutes a transfer unit that transfers a toner image onto the recording paper at a contact point relative to the peripheral surface of the photosensitive drum 50 via a carrier belt 80B. The carrier belt 80B is trained around the transfer roller 80 and a drive roller 80A which rotates in the counterclockwise direction, and the image is transferred while the recording paper is being carried by the carrier belt 80B. Reference numeral 80C denotes cleaning means which cleans the surface of the carrier belt 80B.

Reference numeral 90 denotes a precharging electrode which is located on the upstream side of a cleaning device 100 and which electrically charges the residual toner so as to be easily removed from the peripheral surface of the photosensitive drum 50 after the toner image is transferred onto the recording paper.

Reference numeral 110 and 120 denote an electrically conductive brush that forms cleaning means of the cleaning device 100 and an electrically conductive recovery roller, and 130 denotes a waste toner recovery unit for storing the toner recovered by the cleaning means. They are contained in the drum cartridge D by which the photosensitive drum 50 is supported.

From the photosensitive drum 50 that has passed through the precharging electrode 90 is removed the residual toner by the electrically conductive brush 110 that is in slide contact thereto in response to signals from the control unit. The residual toner adhered to the electrically conductive brush 110 is adsorbed by the electrically conductive recovery roller 120 and is sent to the waste toner recovery unit 130.

The waste toner recovery unit 130 is provided with a waste toner feed rod 131 and a deformable toner recovery bag 132. The residual toner, i.e., the waste toner sent by the recovery roller 120 is contained in the bag 132 via the waste toner feed rod 131.

Thus, the photosensitive drum 50 with its peripheral surface being cleaned is electrically charged again by the charging device 190 to be ready for forming a new image and, at the same time, the electrically conductive brush 110 is released from the slide contacting condition.

On the other hand, the recording paper onto which the toner image is transferred at the transfer unit is separated from the peripheral surface of the photosensitive drum 50 and is sent to a fixing device 60. Reference numeral 63 denotes a pair of heating rollers for fixing, and 64 denotes a pair of paper-exhaust rollers. The recording paper on which the toner is melt-adhered by the pair of heating rollers 63 is exhausted from the fixing device by the pair of paper-exhaust rollers 64.

Reference numerals 73 and 74 denote paper-exhaust guides for guiding the recording papers exhausted by the pair of paper-exhaust rollers 64 to the upper portion of the apparatus. The recording papers are carried by carrier rollers 65, 66 and 67, and are exhausted and are stacked on a tray 75 with their image-bearing surfaces being faced downwards.

Described below is the constitution of a developing device 600.

As described earlier, the device 600 comprises the developing means 611A containing Y (yellow) developer, developing means 611B containing M (magenta) developer, developing means 611C containing C (cyan) developer, and developing means 611D containing BL (black) developer. The above Y, M and C developing means are contained in a frame 602 of a cartridge to form a color developing means, and are detachably set through a window 713 provided in a frame 701 of a clamshell opening/closing unit 700 formed on a base plate 800 of the image forming apparatus 51 being guided along guide rails 713A and 713B. The developing means 611D containing black developer is guided along a guide rail 713C and is detachably and independently set to the opening/closing unit 700 through the window 713.

The above four developing means are constituted in the same manner and, hence, the constitution of the means 611A only will be described below. A container 603 of the developing means contains the aforementioned developing roller (developing sleeve) 612 and stirring rollers 614, 615, and the developing roller 612 has at its both ends cylindrical portions 613 that are greater by a predetermined amount than the outer diameter of the roller 612. On the right side of the container 603 is provided a gear train 630 for transmitting drive force to the rollers and on the left side of the container 603 is provided a toner receiving port 621, as shown in FIG. 14.

There is provided a port opening/closing member 618 that is urged by a spring 617 and a guide pin 616 so as to close the receiving port 621 along a rail 619 that is provided in the container 603.

Being urged by a spring 625 (which may be a leaf spring or a coil spring), the developing means 611A comes at its outer-diameter portions 613 of the developing roller 612 into pressed contact with the peripheral surface of the photosensitive drum 50. Thus, the developing roller 612 and the photosensitive drum 50 maintain a gap that is best suited for forming a magnetic brush therebetween.

Described below are a toner feeding tank 200 and a toner feeding device 250.

As shown in FIGS. 12 to 15, the tank 200 have containers 201A, 201B, 201C and 201D of the same shape containing toners of different colors Y, M, C and BL arranged in line along the frame 701 of the clamshell opening/closing unit 700. The stirring shafts and spiral rotary shafts 208 of the toner containers 201A, 201B, 201C and 201D are rotated by a drive motor 205 via gears 205A, 206, 207 and 208A. The spiral rotary shafts 208 are provided in toner carrier ports 209 of the tank 200. One side of the hoses have ends designated at 272A, 272B, 272C and 272D are connected to the carrier ports 209, flexible spiral members 271 connected to the spiral rotary shafts 208 are provided in the hoses, and rotational force is transmitted to the members 271 by the turn of the spiral rotary shafts 208 to carry the toner.

The ends on the other side of the hoses are connected to introduction pipes 259 leading to distributing vessels 251 for separate toners in the toner feeding device 250. The vessel 251 has a toner feeding port 257. A rail 254 is provided for the vessel 251, a port opening/closing member 258 is provided to slide on the rail 254, the port opening/closing member 258 being always urged rightwardly by a pin 252 and a spring 255 provided on an extended portion 251A at the bottom of the vessel 251. The feeding port 257 is usually closed by the port opening/closing member 258.

The bottom extended portion 251A of the distributing vessels 251 in the toner feeding device has pins 266, 267 and 264 that are studded to fit to elongated holes 708 and 709 formed in the frame 701 of the clamshell opening/closing unit 700, and is coupled to a folded portion 262 of the plate 261 that can slide in the direction of the elongated holes.

On the other hand, the frame 701 of the clamshell opening/closing unit 700 can be opened and closed by a rotary shaft 702 that fits to a bearing 802 provided on a frame 801 of the base plate 800.

Further, a cam lever 703 having pin-fitting grooves 703A, 703B, 703C and 703D is provided. These grooves are fitted to pins 704 and 705 fastened to the frame 701 of the clamshell opening/closing unit 700, to a pin 266 fastened to the plate 261, and to a pin 806 fastened to the frame 801 of the base plate 800, respectively.

Figure 15:
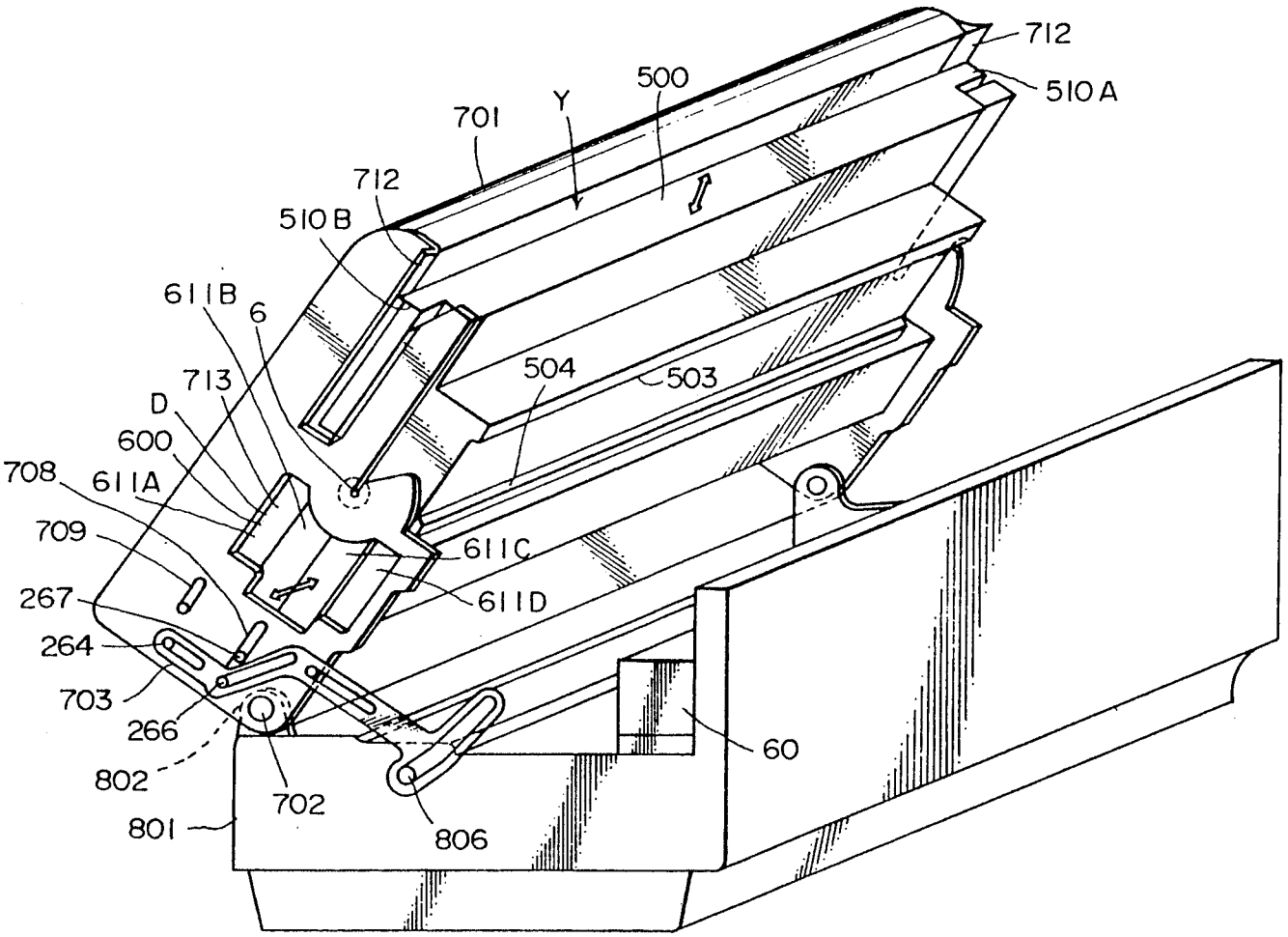

When the clamshell opening/closing unit 700 is opened from the state shown in the side view of FIG. 12 to the state shown in the perspective view of FIG. 15, the cam lever 703 changes its position to the state shown in FIG. 15, whereby the pins 266, 267 and 264 move in the elongated holes 708 and 709, and the plate 261 having pins studded thereon moves toward the left.

Thus, the distributing vessel 251 of the toner feeding portion fastened by the bottom extended portion 251A to the folded portion 262 of the plate 261, moves toward the left. Then, the vessel 251 is separated away from the container 603 of the developing means, the port opening/closing member 258 closes the feeding port 257 being urged by the spring 255, and the toner is prevented from spilling from the distributing vessel 251.

The toner receiving port 621 of the container 603 of the developing means 600 is closed, too, as the port opening/closing member 618 slides on the rail 619 being urged by the spring 617. The toner in the container 603 of the developing means 600 is prevented from spilling, too.

When the clamshell opening/closing unit 700 is being opened as described above, the toner feeding unit 250 moves backwards to close the feed port 257 and to close the toner receiving port 261 of the container 603 of the developing means 600, automatically and completely preventing the toner from spilling.

When the clamshell opening/closing unit 700 is opened, a cartridge consisting of developing means of three colors Y, M and C is easily attached and detached as a single unit through the window 713 of the clamshell being guided along the guide rails 713A and 713B.

The developing means 611D for the black developer is also attached and detached easily as an independent cartridge through the window 713 of the frame 701 of the clamshell opening/closing unit being guided along the guide rail 713C.

The color developing unit and the developing means 611D that contains black developer have drive gears 803 and 804 for the stirring rollers 614 and 615, the drive gear 804 being opposed to a drive gear 805 of the side of the main body. The drive gear 805 of the side of the main body is connected to a motor that is not shown. Under the condition where the drum cartridge D is not mounted on the clamshell opening/closing unit 700, the drive gear 804 of the stirring roller 615 maintains a predetermined clearance L so as not to come into engagement with the drive gear 805 of the side of the main body as indicated by a dotted line in FIG. 13. When the drum cartridge D is mounted on the clamshell opening/closing unit 700, the developing unit Y and the developing means 611D containing black developer are pushed by the drum cartridge D, whereby there exists no clearance L, the drive gear 804 provided on the stirring roller 615 meshes with the drive gear 805 of the side of the main body, and the drive gears 804 of the developing unit Y and the developing means 611D containing black developer automatically engage with or disengage from the drive gear 805 of the side of the main body as the drum cartridge D is attached or detached.

When the drum cartridge D is mounted as described above, the drive gears 804 of the developing unit Y and the developing means 611D containing black developer are in mesh with the drive gear 805 on the side of the main body. Therefore, the developing unit Y and the developing means 611D containing black developer are limited from being pulled out, and the photosensitive drum 50 supported by the drum cartridge D does not come in contact with the developing unit Y and the developing means 611D containing black developer, and is not scarred. When the drum cartridge D is not mounted, the drive gears 804 of the developing unit Y and the developing means 611D containing black developer are not in mesh with the drive gear 805 on the side of the main body. It is therefore allowed to smoothly remove the developing unit Y and the developing means 611D containing black developer.

A cartridge 500 for photosensitive drum including cleaner 100, charging device 190, precharging electrode 90 and toner recovering unit 130, can also be easily attached or detached under the condition where the clamshell opening/closing unit is opened as shown in a perspective view of FIG. 15 being guided and slid at its guide portions 510A and 510B on both sides of the cartridge 500 along a guide rail introducing portion 712A and a guide rail 712. The drum shaft 6 is set in position along guides 711 on both sides of the frame.

Legs 503 and 504 of the cartridge work to facilitate the checking and cleaning when the cartridge 500 that is removed from the clamshell opening/closing unit 700 is placed on a plate.

When the clamshell opening/closing unit is opened as described above, the cartridges can be attached or detached to facilitate the maintenance and checking and can further be replaced by new ones. Furthermore, the three separate cartridges help prevent the toners of different colors from being loaded in incorrect sequences. With the drum cartridge that contains the photosensitive drum being mounted at right angles with the developing cartridge, the mounting operation becomes more safe and reliable than when they are mounted in parallel particularly when full-color images are to be obtained and when multi-color images are to be obtained. In particular, the structure can be simplified when it is designed to attach or detach the photosensitive drum cartridge prior to attaching or detaching the developing cartridge. If this is done in opposite order, the developing roller and other members must be moved away so that the surface of the photosensitive member is not scarred when the developing means is being attached or detached. Though the structure may not become so complex, it is better not to employ unnecessary mechanism.

In this embodiment, each developing means is equipped with the toner feeding tank 200 and the toner feeding device 250. However, the toner feeding tank 200 and the toner feeding device 250 may not be provided but, instead, the toner may be contained in the developing means in an amount to meet the life of the developing means. That is, when the toner is depleted, the developing means is discarded together with the cartridge and a new developing means in a new cartridge is employed.

In the foregoing embodiments, developing means of different colors were contained in a single cartridge and developing means of black toner was contained in another cartridge so as to be renewed depending upon the frequencies of their use. When multi-color images are formed, particular colors may be used at higher frequencies depending upon the manner of use by the users. In such a case, sub-cartridges may be contained in the cartridge, so that developing means of particular colors can be replaced at an early time.

EFFECT OF THE INVENTION

According to the apparatus of the present invention, the positioning means operates according to the opening or closing of the clamshell opening/closing unit. Therefore, the positioning is effected to hold the shaft of the photosensitive drum through simple operation and, at the same time, the positioning can be easily released.

According to the apparatus of the present invention, the positioning means operates interlocking to the operation for attaching or detaching the drum cartridge to the clamshell opening/closing unit. Therefore, the positioning is effected to hold the shaft of the photosensitive drum through simple operation and, at the same time, the positioning can be easily released. Furthermore, even when the clamshell opening/closing unit is opened from the base plate, the drum cartridge remains held in position. Therefore, though the drum cartridge may be contacted during the operation of checking and cleaning, the photosensitive drum is not deviated from its set position and is reliably held in position.

According to the present invention, those related to the photosensitive drum and those related to the developing means in the image forming apparatus are constituted in the form of cartridges, and are detachably attached. Therefore, they can be disassembled depending upon their functions, and the interior of the apparatus can be closely inspected facilitating the operation for checking and cleaning. Furthermore, the photosensitive member and the developing means are detachably attached at right angles with each other eliminating the probability of causing damage to the surface of the photosensitive drum when the developing means is to be attached or detached. Therefore, there is always obtained stable image of high quality without involving disturbance in the image.

According to the present invention as described in the foregoing, the developing unit is pushed by the drum cartridge that is mounted, and the drive gear of the developing unit meshes with the drive gear of the side of the main body. When the drum cartridge is mounted, therefore, the drive gear of the developing unit meshes with the drive gear of the side of the main body to limit the developing unit from escaping. The developing unit can be attached or detached under the condition where the drum cartridge is not mounted. Therefore, the developing unit can be smoothly attached or detached without giving scars to the photosensitive drum of the drum cartridge.

What is claimed is:

1. In a clamshell-type electrophotographic image forming apparatus wherein a clamshell opening/closing unit is provided on a base plate so as to be opened and closed, a drum cartridge by which a photosensitive drum is supported is removably accommodated in said clamshell opening/closing unit, and a developing unit that has developing means and a toner feeding device is removably accommodated in said clamshell opening/closing unit, the improvement characterized by the inclusion of a cam lever having pin-fitting grooves (703A–703D), a pin (806) formed on said base plate (801) and engaged with said groove (703D), pins (704, 705) formed on a frame of said clamshell opening/closing unit and engaged with said grooves (703A, 703C), respectively, and a pin (266) formed on a plate (261) for closing the opening of said toner feeding device and engaging with said groove (703B).

wherein, when said clamshell opening/closing unit is opened, said opening of said toner feeding device is closed by said plate (261), moved by said cam lever through said pin (266), and said groove (703B) and wherein an opening angle of said clamshell opening/closing unit is regulated by said cam lever through said pins (704, 705, 806) and said grooves (703A, 703C, 703D).

2. In a clamshell-type electrophotographic image forming apparatus wherein a clamshell opening/closing unit is provided on a base plate so as to be opened and closed, and a drum cartridge, by which a photosensitive drum is supported, is removably accommodated in said clamshell opening/closing unit, the improvement characterized in that a drum shaft of said photosensitive drum of said drum cartridge accommodated in said clamshell opening/closing unit is positioned by positioning means activated by a closing of said clamshell opening/closing unit, said positioning means comprising a position limiting lever rotatably supported by a pin mounted on said clamshell opening/closing unit, said positioning limiting lever having an engaging pawl at one end thereof, and a guide groove at the other end thereof; and a guide pin mounted on said base plate adapted to fit into said guide groove whereby said position limiting lever is rotated to engage said engaging pawl with said drum shaft for positioning when said clamshell opening/closing unit is closed.

3. In a clamshell-type electrophotographic image forming apparatus wherein a clamshell opening/closing unit is provided on a base plate so as to be opened and closed, and a drum cartridge, by which a photosensitive drum is supported, is removably accommodated in said clamshell opening/closing unit, the improvement which comprises a drum shaft of said photosensitive drum being positioned by a positioner which operates according to insertion or removal of said drum cartridge, said positioner comprising a position limiting lever rotatably supported by a pin mounted near a shaft support portion of said clamshell opening/closing unit, said position limiting lever having an engaging pawl, a disengaging pawl, a stopper, and an escape portion formed on said disengaging pawl; and a protrusion formed on a side wall of said drum cartridge between said engaging pawl and said disengaging pawl, said protrusion pushing said engaging pawl, whereby said stopper comes in contact with said drum shaft of said photosensitive drum to limit the position of said drum cartridge engaged with said shaft support portion when said drum is inserted in said clamshell opening/closing unit, and said protrusion pushes said disengaging pawl, whereby said stopper is released from said drum shaft of said photosensitive drum when said drum cartridge is removed from said clamshell opening/closing unit.

4. In a clamshell-type electrophotographic image forming apparatus wherein a clamshell opening/closing unit is provided on a base plate so as to be opened and closed, and a drum cartridge, by which a photosensitive drum is supported, is removably accommodated in said clamshell opening/closing unit, the improvement which comprises a drum shaft of said photosensitive drum being positioned by a positioner which operates according to insertion or removal of said drum cartridge, said positioner comprising a position limiting lever rotatably supported by a pin mounted near a shaft support portion of said clamshell opening/closing unit, said position limiting lever having a guide pawl, an engaging pawl, a stopper, and protrusions formed on a side wall of said drum cartridge, a first protrusion pushing said engaging pawl, whereby said stopper comes in contact with said drum shaft of said photosensitive drum to limit the position of said drum cartridge engaged with said shaft support portion when said drum cartridge is inserted in said clamshell opening/closing unit, and a second protrusion pushing said guide pawl, whereby said stopper is released from said drum shaft of said photosensitive drum, when said drum cartridge is removed from said clamshell opening/closing unit.

* * * * *